US008292381B2

(12) United States Patent
McDaniel et al.

(10) Patent No.: US 8,292,381 B2
(45) Date of Patent: Oct. 23, 2012

(54) CONSUMER APPLIANCE SUCH AS DISHWASHER WITH SOFT OPEN DOOR MECHANISM

(75) Inventors: Aaron Matthew McDaniel, Louisville, KY (US); John Alexander Gardner, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/986,445

(22) Filed: Jan. 7, 2011

(65) Prior Publication Data

US 2012/0176014 A1 Jul. 12, 2012

(51) Int. Cl.

| | |
|---|---|
| ***A47B 95/02*** | (2006.01) |
| ***A47B 88/00*** | (2006.01) |
| ***E05F 1/10*** | (2006.01) |
| ***E05F 1/00*** | (2006.01) |

(52) U.S. Cl. ..... 312/319.2; 312/328; 49/386; 49/387

(58) Field of Classification Search ..... 312/319.2, 312/192, 319.1, 319.4, 326, 327, 328, 329; 49/386, 387; 16/286

See application file for complete search history.

(56) References Cited

U.S. PATENT DOCUMENTS

| | | | | |
|---|---|---|---|---|
| 2,921,575 | A * | 1/1960 | Fry | 126/191 |
| 3,049,114 | A * | 8/1962 | Carnahan et al. | 126/191 |
| 3,603,658 | A * | 9/1971 | Bergeson | 49/386 |
| 4,966,403 | A * | 10/1990 | Nordstrom | 296/76 |
| 5,274,954 | A * | 1/1994 | Quarfordt et al. | 49/386 |
| 5,988,933 | A * | 11/1999 | Wilhelmstatter et al. | 403/381 |
| 7,640,696 | B2 * | 1/2010 | Yingst | 49/152 |
| 2004/0113531 | A1 * | 6/2004 | Raches | 312/319.2 |
| 2005/0076938 | A1 * | 4/2005 | Jordan et al. | 134/183 |
| 2006/0005468 | A1 * | 1/2006 | McCullough | 49/387 |
| 2008/0189906 | A1 * | 8/2008 | Resnik et al. | 16/54 |
| 2008/0197652 | A1 * | 8/2008 | Stratten | 296/57.1 |
| 2008/0272678 | A1 * | 11/2008 | Tynes et al. | 312/319.4 |
| 2009/0072686 | A1 * | 3/2009 | Vooren et al. | 312/319.4 |
| 2010/0127606 | A1 * | 5/2010 | Collene et al. | 312/327 |

FOREIGN PATENT DOCUMENTS

| | | | |
|---|---|---|---|
| GB | 2219623 | A * | 12/1989 |
| WO | WO 2006137039 | A2 * | 12/2006 |

* cited by examiner

*Primary Examiner* — David Dunn
*Assistant Examiner* — Ryan A Doyle
(74) *Attorney, Agent, or Firm* — Dority & Manning, P.A.

(57) ABSTRACT

A consumer appliance with a soft open door mechanism includes a cabinet having top and a bottom and defining an opening along a front side. A door has a top and a bottom and is attached by a hinge to the front side of the cabinet. The hinge is at a bottom of the door so that the door is movable between an upright position closing the opening and a substantially horizontal position opening the opening. A spring is mounted in the cabinet so as to oppose movement of the door toward the horizontal position. A damping device is mounted within the cabinet activatable by an opening movement of the door toward the horizontal position to slow the door motion. The damping device is not active until the door has moved a distance from the upright position toward the horizontal position. Again, various options and modifications are possible.

14 Claims, 8 Drawing Sheets

CONSUMER APPLIANCE SUCH AS DISHWASHER WITH SOFT OPEN DOOR MECHANISM

FIELD OF THE INVENTION

The present disclosure relates generally to door opening mechanisms for consumer appliances such as dishwashers.

BACKGROUND OF THE INVENTION

Dishwashers of various types have been proposed with a bottom-hinged door. Typically a user pulls on the top of the door to open it. In some dishwashers, the user must manipulate a mechanism, handle, latch, button, etc., of some sort before the door can be opened. In others, the user must simply pull hard enough to overcome a typically spring-loaded mechanism to open the door.

The physics of door opening can thus vary from the start in terms of force required. Doors also vary in weight and center of gravity as well from model to model, and both of these can vary for a particular model depending on whether a detergent container or the like housed in the door is full or empty. Counterbalancing springs are often included to oppose door opening force or to assist in holding a door closed or reclosing it. Those springs may be more active around the closed position (with the door vertical) than around the opened position (with the door horizontal).

Some doors may move somewhat freely or even accelerate as they approach the fully opened (horizontal) position, especially if the doors have compartments loaded with liquids. The pivoting center of gravity of the door has a weight that applies a torque when it moves out from over the hinge at the bottom of the door. Rapid movement toward the end of travel can lead to hard bounces off stops or even damage for some models with less than optimal opening parameters and/or due to user inattention.

Accordingly, other designs for door mechanisms for consumer appliances such as dishwashers, including those addressing one or more drawbacks of conventional devices and dishwashers would be welcome.

BRIEF DESCRIPTION OF THE INVENTION

Aspects and advantages of the invention will be set forth in part in the following description, or may be obvious from the description, or may be learned through practice of the invention.

According to certain aspects of the present disclosure, a consumer appliance with a soft open door mechanism includes a cabinet having top and a bottom and defining an opening along a front side. A door has a top and a bottom and is attached by a hinge to the front side of the cabinet. The hinge is at a bottom of the door so that the door is movable between an upright position closing the opening and a substantially horizontal position opening the opening. A line has a first end connected to the cabinet at a connection point spaced toward the top of the cabinet from the hinge and having a second end attached to a door arm extending from the door adjacent the hinge. The line includes a tension spring that is stretched in tension during opening of the door. A roller is attached to the cabinet spaced inwardly from the door. A central portion of the line passes through the roller. A damping device is mounted within the cabinet activatable by an opening movement of the door toward the horizontal position to slow the door motion. Various options and modifications are possible.

According to certain other aspects of the disclosure, a consumer appliance with a soft open door mechanism includes a cabinet having top and a bottom and defining an opening along a front side. A door has a top and a bottom and is attached by a hinge to the front side of the cabinet. The hinge is at a bottom of the door so that the door is movable between an upright position closing the opening and a substantially horizontal position opening the opening. A spring is mounted in the cabinet so as to oppose movement of the door toward the horizontal position. A damping device is mounted within the cabinet activatable by an opening movement of the door toward the horizontal position to slow the door motion. The damping device is not active until the door has moved a distance from the upright position toward the horizontal position. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
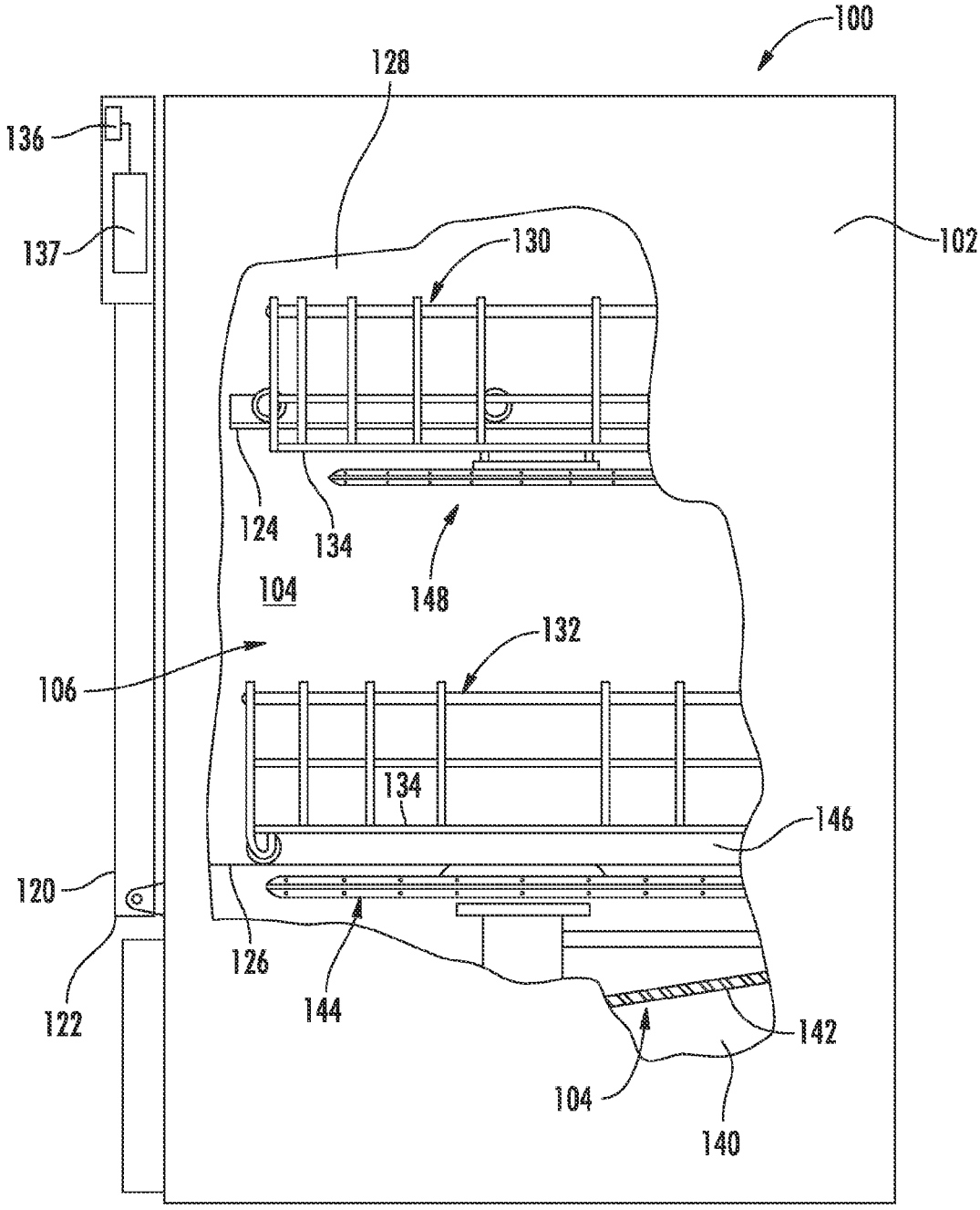
FIG. 1 provides a side partial cut-away view of an exemplary dishwasher that may be configured in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As discussed in greater detail below, embodiments of the present disclosure relate to soft open door mechanism for consumer appliances such as dishwashers. FIG. 1 depicts an exemplary domestic dishwasher 100 that may be configured in accordance with aspects of the disclosure. For the particular embodiment of FIG. 1, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position for loading and unloading of articles from the dishwasher. Upper and lower guide rails 124, 126 are mounted on tub side walls 128 and accommodate upper and lower roller-equipped racks 130, 132, respectively. Each of the upper and lower racks 130, 132 is fabricated into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside the wash chamber 106. A silverware basket (not shown) may be removably attached to the lower rack 132 for placement of silverware, utensils, and the like, that are too small to be accommodated by the upper and lower racks 130, 132.

The dishwasher 100 further includes a lower spray-arm-assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIG. 1 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles.

Figure 2:
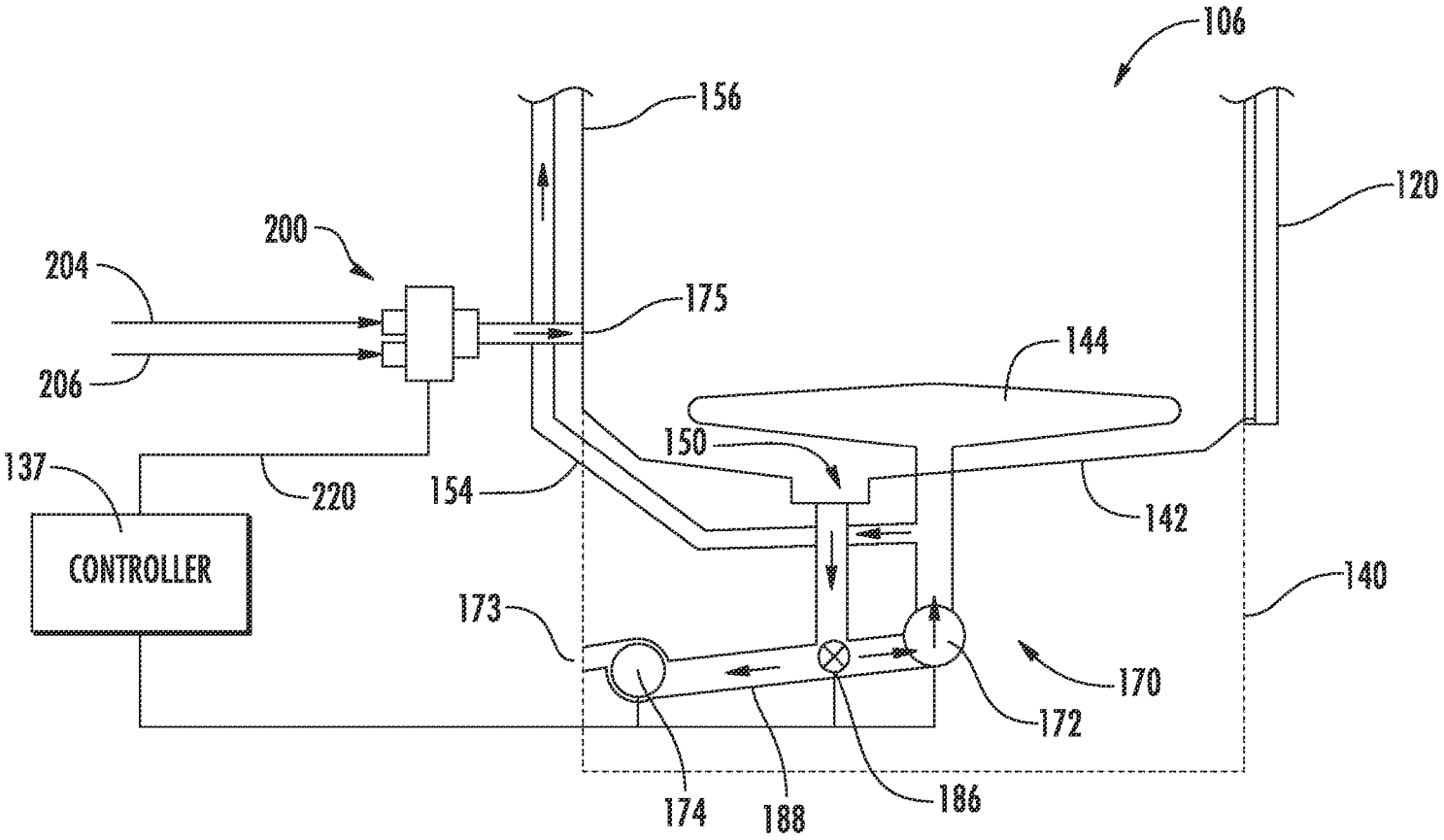
FIG. 2 is a schematic view of one possible fluid system the dishwasher of FIG. 1.

FIG. 2 schematically illustrates an embodiment of a fluid circulation assembly 170 configured below the wash chamber 106. Although one embodiment of a fluid circulation assembly that is operable to perform in accordance with aspects of the disclosure is shown, it is contemplated that other fluid circulation assembly configurations may similarly be utilized without departing from the spirit and scope of the invention. The fluid circulation assembly 170 includes a circulation pump assembly 172 and a drain pump assembly 174, both in fluid communication with the sump 150. Additionally, the drain pump assembly 174 is in fluid communication with an external drain 173 to discharge used wash liquid. Further, the circulation pump assembly 172 is in fluid communication with lower spray arm assembly 144 and conduit 154 which extends to a back wall 156 of wash chamber 106, and upward along the back wall 156 for feeding wash liquid to the mid-level spray arm assembly 148 (FIG. 1) and the upper spray arm assembly. This configuration also applies to a drawer-type of dishwasher, as mentioned above.

As wash liquid is pumped through the lower spray arm assembly 144, and further delivered to the mid-level spray arm assembly 148 and the upper spray arm assembly (not shown), washing sprays are generated in the wash chamber 106, and wash liquid collects in the sump 150. The sump 150 may include a cover to prevent larger objects from entering the sump 150, such as a piece of silverware or another dishwasher item that is dropped beneath lower rack 132. A coarse filter and a fine filter (not shown) may be located adjacent the sump 150 to filter wash liquid for sediment and particles of predetermined sizes before flowing into the sump 150. Furthermore, a turbidity sensor may be coupled to the sump 150 and used to sense a level of sediment in the sump 150 and to initiate a sump purge cycle where the contents or a fractional volume of the contents of the sump 150 are discharged when a turbidity level in the sump 150 approaches a predetermined threshold. The sump 150 is filled with water through an inlet port 175 which outlets into wash chamber 106, as described in greater detail below.

As shown, a drain valve 186 is established in flow communication with the sump 150 and opens or closes flow communication between the sump 150 and a drain pump inlet 188. The drain pump assembly 174 is in flow communication with the drain pump inlet 188 and may include an electric motor for pumping fluid at the inlet 188 to an external drain system via drain 173. In one embodiment, when the drain pump is energized, a negative pressure is created in the drain pump inlet 188 and the drain valve 186 is opened, allowing fluid in the sump 150 to flow into the fluid pump inlet 188 and be discharged from fluid circulation assembly 170 via the external drain 173. Alternatively, pump assemblies 172 and 174 may be connected directly to the side or the bottom of sump 150, and the pump assemblies may each include their own valving replacing drain valve 186. Other fluid circulation systems are possible as well, drawings fluid from sump 150 and providing as desired within wash chamber 106 or draining out of washing machine 100.

Referring to FIG. 2, a water supply 200 may be configured with the inlet port 175 for supplying wash liquid to the wash chamber 106. The water supply 200 may provide hot water only, cold water only, or either selectively as desired. As depicted, water supply 200 has a hot water inlet 204 that receives hot water from an external source, such as a hot water heater and a cold water input 206 that receives cold water from an external source. It should be understood that the term "water supply" is used herein to encompass any manner or combination of valves, lines or tubing, housing, and the like, and may simply comprise a conventional hot or cold water connection.

Figure 3:
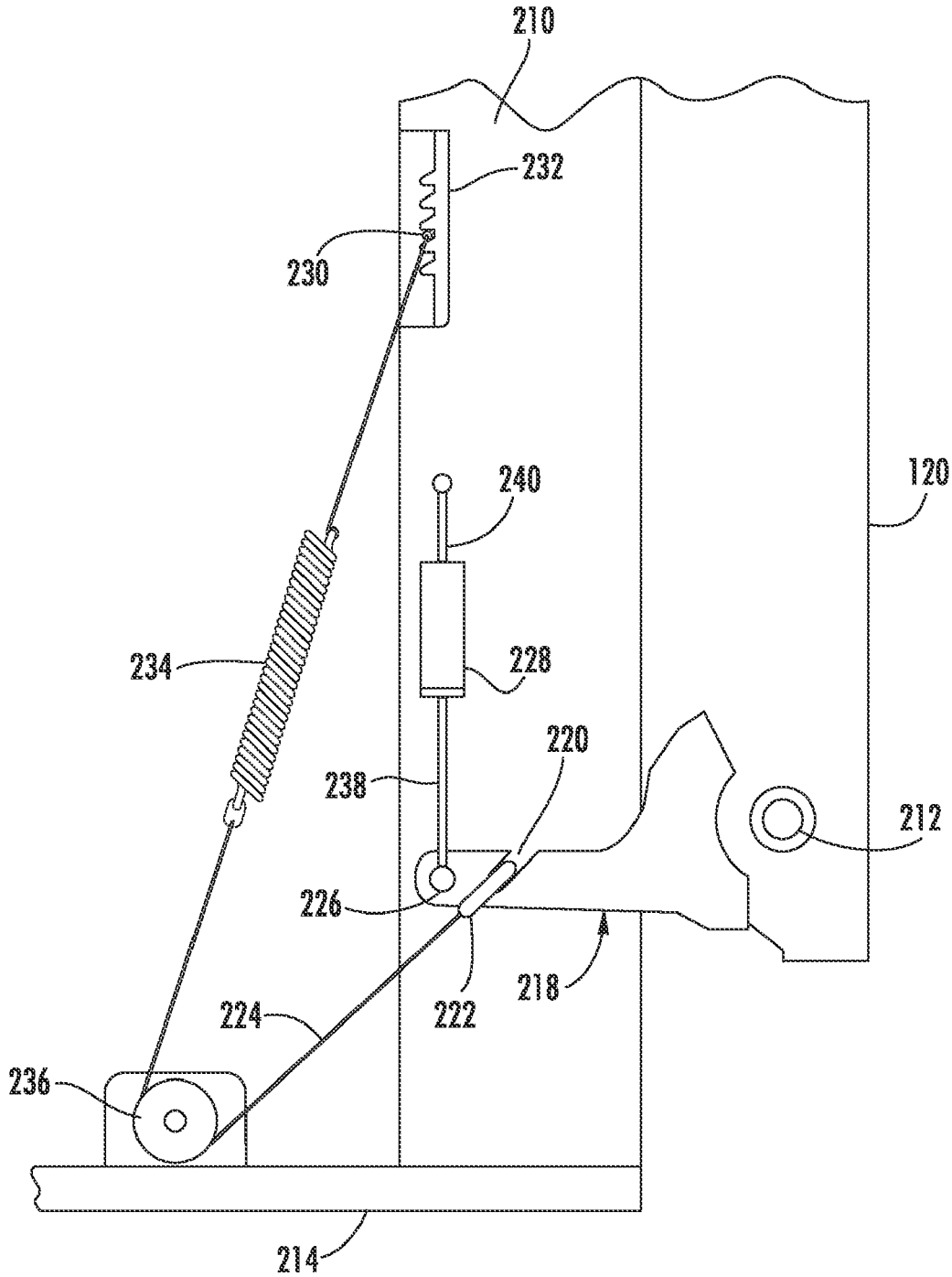
FIG. 3 provides a schematic side view of one possible dishwasher door opening mechanism in a closed position according to certain aspects of the invention.
Figure 4:
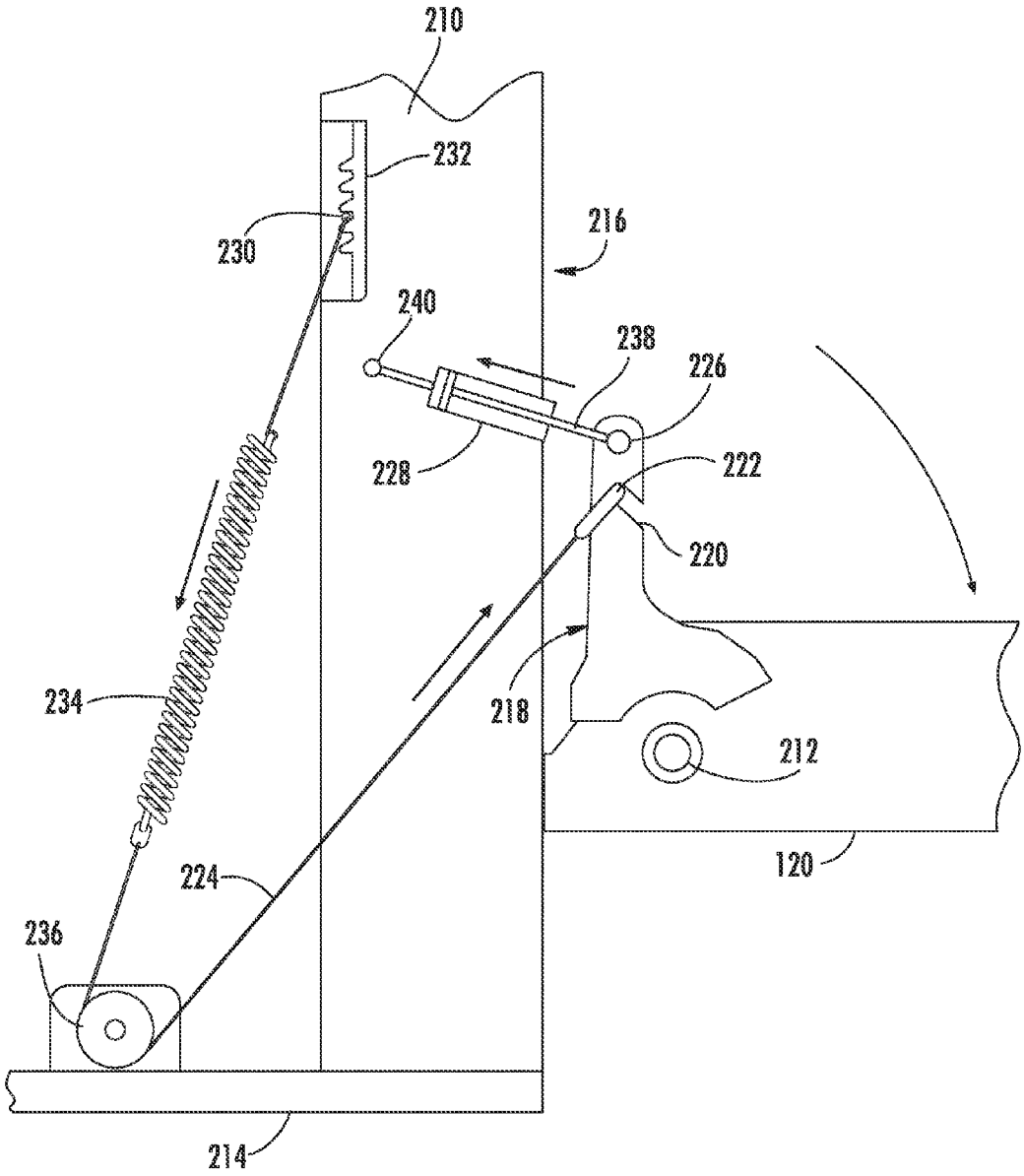
FIG. 4 provides a schematic side view of the mechanism of FIG. 3 in an opened position.

FIGS. 3 and 4 show one example of a door opening mechanism for a consumer appliance such as a dishwasher according to certain aspects of the present disclosure. It should be understood that the mechanisms disclosed herein can be used on one or both sides of the appliance door, if desired, although only one side is shown for clarity. Further, although the present disclosure is shown for convenience in connection with a typical dishwasher configuration, the mechanisms here have applicability to various consumer appliances.

As shown, door 120 is attached to a side member 210 of cabinet 102 (see FIG. 1 for overall view) via a hinge 212 also attached to the cabinet near the bottom of the door. Base member 214 of cabinet 102 extends along a bottom portion of the cabinet. Door 120 is pivotable between a substantially upright, closed position as shown in FIG. 3 and a substantially horizontal open position as shown in FIG. 4. When in the position of FIG. 3, door 120 closes an opening 216 in the front of cabinet 102 as is conventional.

Attached to door 120 near hinge 212 is an arm 218 which moves with the door as it is opened and closed. Arm 218 has a slot 220 for receiving an end 222 of a line 224. Arm 218 also has a hole 226 or other structure for connection to a damper 228.

Line 224 has a second end 230 attached to an adjustable mounting bracket 232 with multiple mounting locations for tensioning the line as desired. Line 224 has at least one tension spring 234 along its length. A roller 236 is attached to a part of cabinet 102 such as base member 214 spaced from door 120.

Damper 228 has a first end 238 attached to arm 218 and a second end 240 attached to a portion of cabinet 102 such as side member 210. Damper 228 may be a conventional pneumatic or hydraulic damper mechanism.

As shown in FIG. 4, when door 120 is pivoted downward, arm 218 correspondingly pivots. Movement of arm 218 causes line 224 to be pulled, thereby stretching and lengthening tension spring 234 and causing a central part of the line to rotate roller 236. Simultaneously, arm 218 compresses damper 228.

If desired, damper 228 may be a partial fill damper, which has less than a 100% fill with a hydraulic fluid such as oil. If so, damper 228 may be activated (i.e., manipulated) without the damping function being active until an amount of motion occurs and the piston within damper 228 begins to contact and compress the hydraulic fluid. For example, if damper 228 were a 10/90 partial fill damper with 10% hydraulic fluid, the damper would not provide substantial damping force until compression (or extension) had reached 90% of the range of motion. Such a damper particularly provides a soft open function at the nearly horizontal stop area (i.e., a "soft open stop"). Accordingly, use of a partial-fill damper, moved continuously whenever door 120 moves but only active at an end portion of the motion toward the horizontal position of FIG. 4, provides a useful soft open stop that can avoid hard bounces at the end of travel as mentioned above. The percentage of fluid in damper 228 diameter of the piston, etc., can be selected in view of the parameters of the door 120 and other components, as desired for a particular application.

It should be understood that modifications are possible. For example, damper 228 could be mounted with second end 240 below arm 218, thereby requiring use of a damper than can operate in extension rather than compression. Also, tension spring 234 could be replaced with a compression spring attached differently as well to push rather than pull arm 218 toward the position of FIG. 3.

Figure 5:
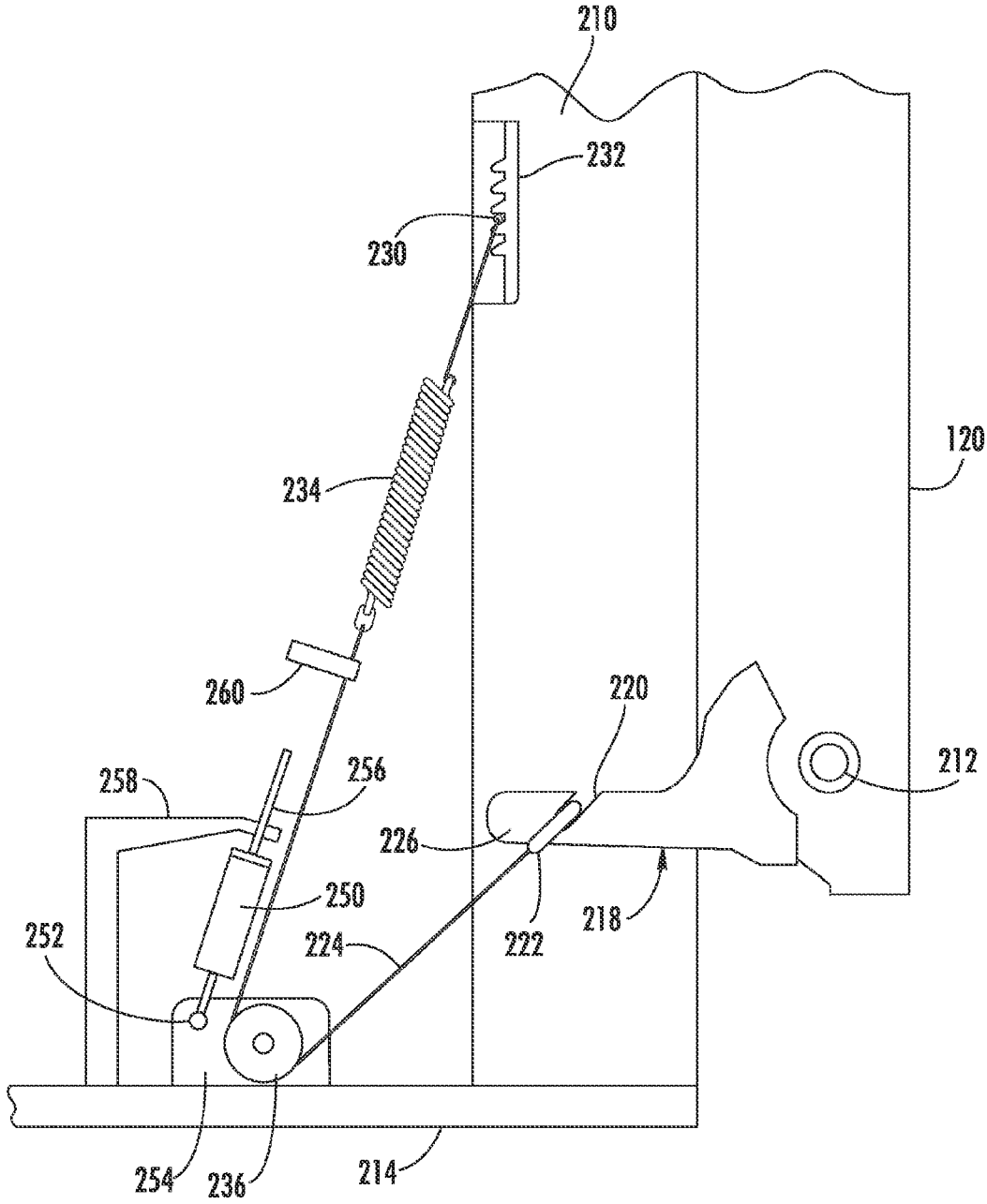
FIG. 5 provides a schematic side view of another possible dishwasher door opening mechanism in a closed position according to certain aspects of the invention.
Figure 6:
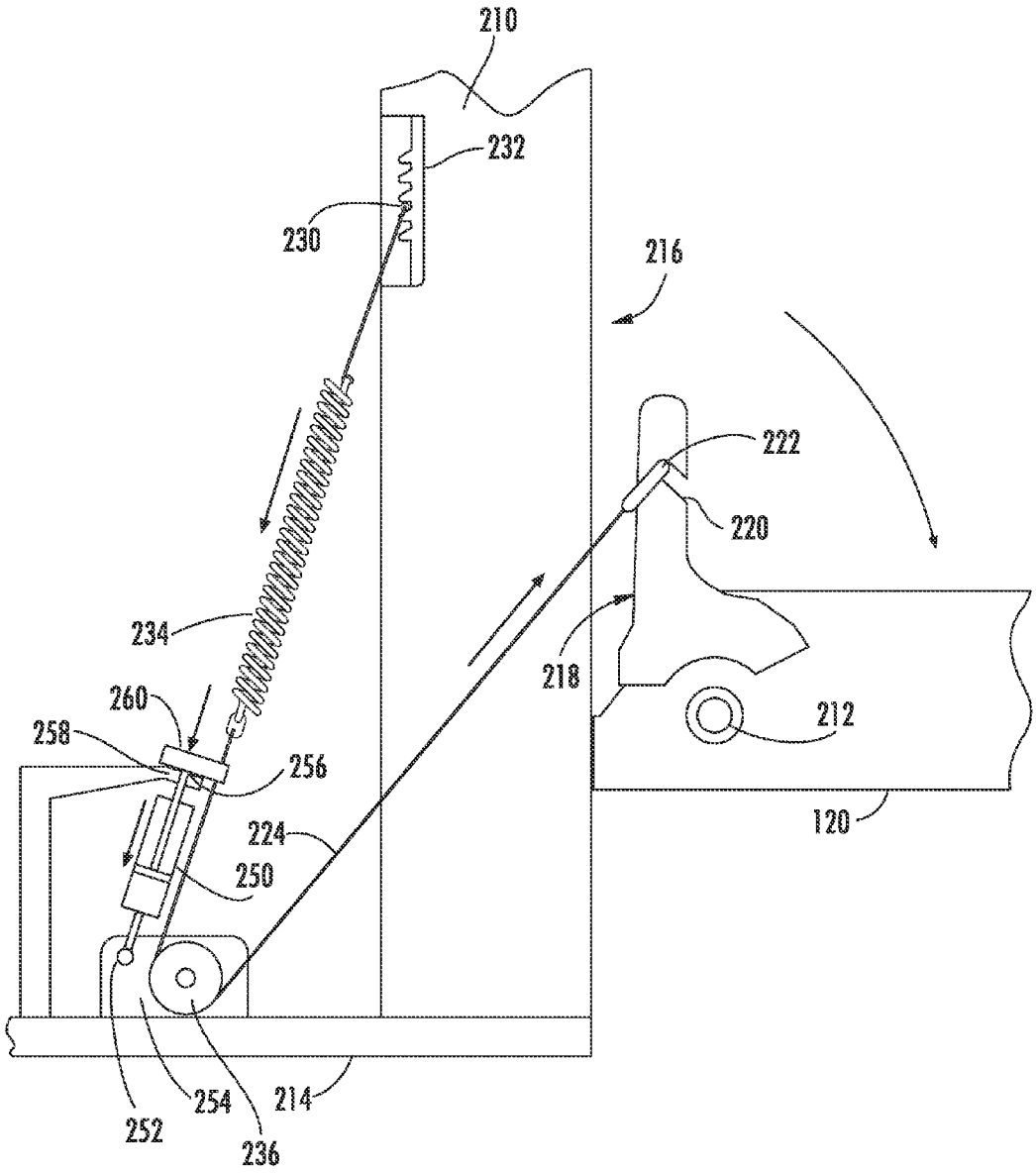
FIG. 6 provides a schematic side view of the mechanism of FIG. 5 in an opened position.

FIGS. 5 and 6 show another example of a soft open door mechanism according to certain other aspects of the invention. Like or similar parts to the example of FIGS. 3 and 4 have like or similar reference numerals hereafter and therefore all need not be discussed again.

The embodiment of FIGS. 5 and 6 includes line 224 mounted to arm 218 and mounting bracket 232 with roller 236 and tension spring 234 in between, as above. Damper 250 has a first end 252 mounted to a portion of cabinet such as roller bracket 254 and a second end 256 held slidably in place by another bracket 258 or other structure within cabinet 102. A stop member 260 extends from line 224 so that when line is pulled damper 250 is compressed.

As illustrated, damper 250 is not a partial fill damper, so the damper is active as soon as end 256 is contacted by stop. In other words, it takes a certain amount of opening of door 120 to move stop 120 down far enough to contact second end 256, at which point damper 250 is active and provides a force to slow the door. Using a conventional damper in this way allows end of 230 of line 224 to be mounted at different locations in bracket 232 for fine tuning, with corresponding changes possible in the location of stop 260 on the line, which can be fixed via a set-screw, for example. Alternatively, stop 260 could be permanently fixed in place and the length of damper 250 (end 256 for example) could be adjustable if such fine tuning feature were desired. Also, damper 250 could be mounted for example to side member 210 near bracket 232 instead of to bracket 254, and could therefore operate in extension rather than compression, if desired.

As another alternative, a partial fill damper could be substituted, as mentioned above. In such case, second end 256 could be fixedly attached to line, for example by attachment to stop 260 or other structure at such location.

Figure 7:
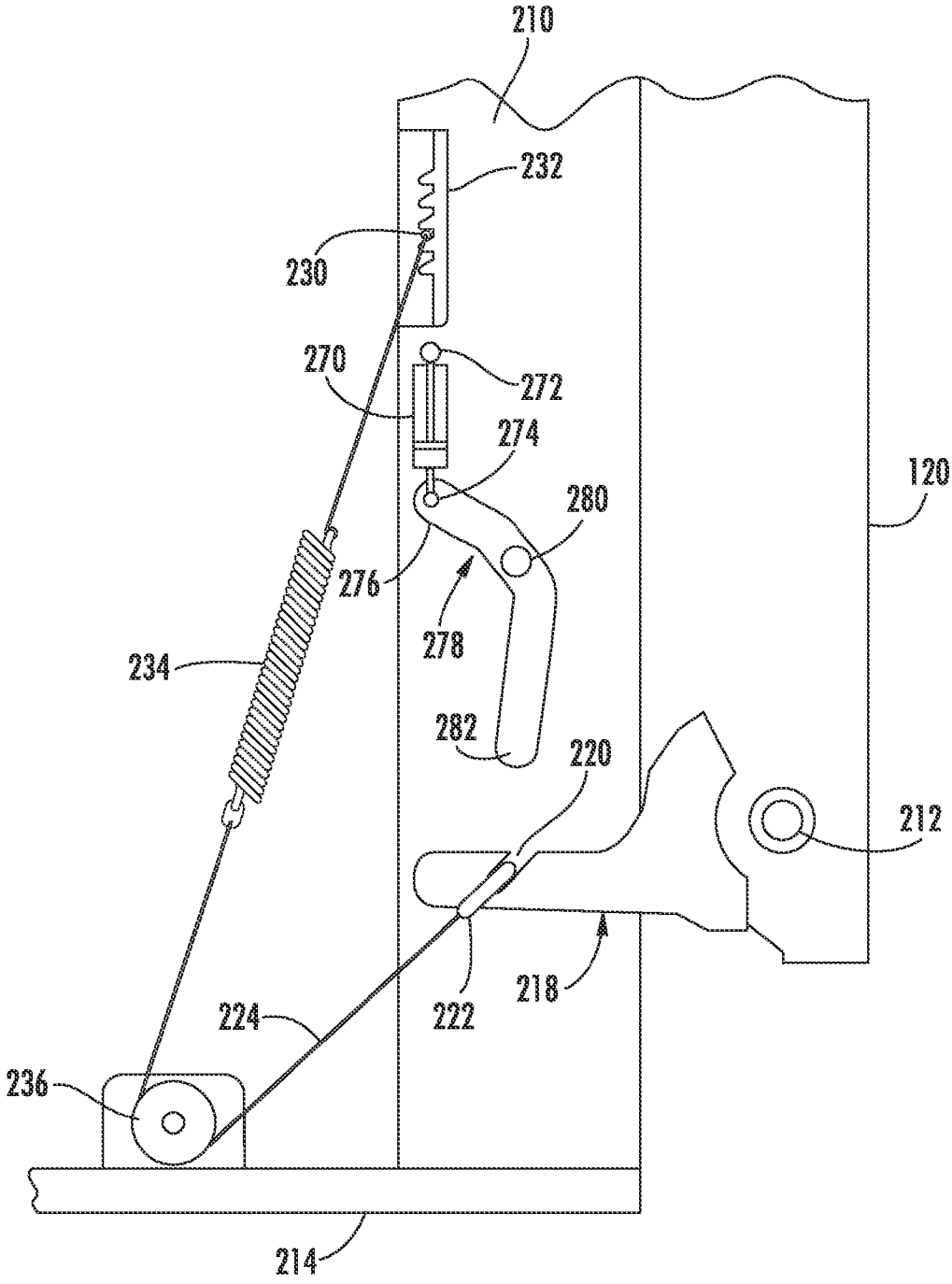
FIG. 7 provides a schematic side view of yet another possible dishwasher door opening mechanism in a closed position according to certain aspects of the invention.
Figure 8:
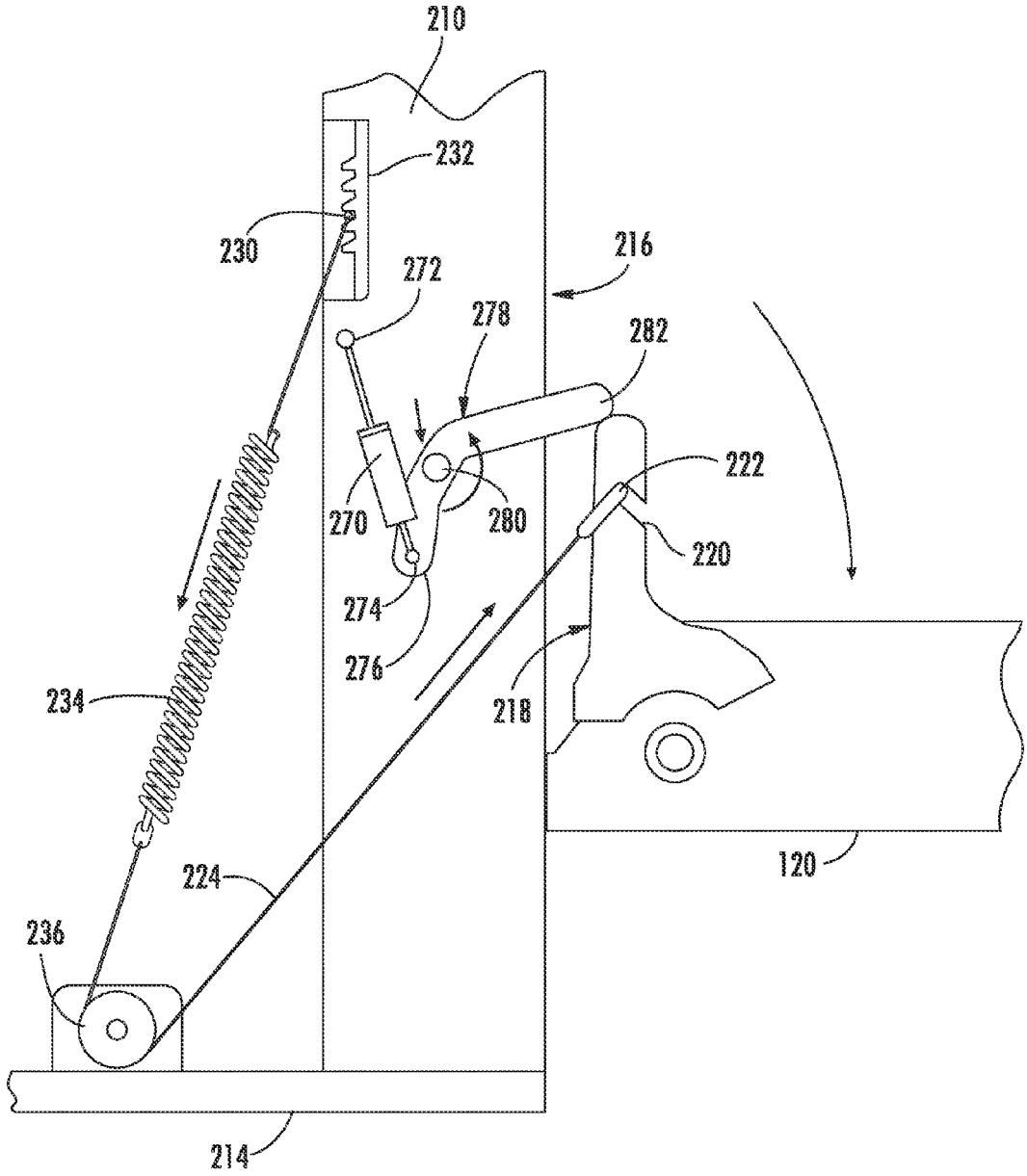
FIG. 8 provides a schematic side view of the mechanism of FIG. 7 in an opened position.

A third example is shown in FIGS. 7 and 8. Again, door 120 is movable about hinge 212 thereby moving arm 218. Line 224 and its components are as shown in FIG. 3 and function similarly. However, damper 270 is mounted at one end 272 to the cabinet such as side member 210 and at the other end 274 to a first end 276 of a trigger arm 278. Trigger arm 278 is mounted at a pivot point 280 to side member 210 and has a second end 282 extending toward arm 218. Trigger arm 278 can be urged toward the position of FIG. 7 (clockwise as shown) via a coil spring (not shown) mounted about pivot point.

A shown in FIG. 7, when door 120 starts to move, arm 218 is not contacting second end 282 of trigger arm 278. Eventually as door 120 is moved further, arm 218 rises to contact second end 282 (a flange, not shown, may be provided on either arm or both to transfer the contact). Further pivoting motion of door 120 toward the horizontal position of FIG. 8 actuates damper 270. The spacing between arm 218 and arm 278 in the door closed position allows use of a conventional (non-partial fill) damper in this embodiment, if desired. That is, damper 270 in such orientation becomes active to oppose motion of the door as soon as the arms are in contact, which is toward the end of travel to the horizontal door position. Again, a soft open stop is achieved in this way. If desired, however, a partial fill damper could be used in this embodiment as well for further fine tuning, possibly with arms 218 and 278 in permanent contact. As above, damper 270 could also be mounted with first end 272 below first end 276 of trigger arm 278 and could thus operate in compression rather than in extension.

In view of the above, various simple and reliable soft open mechanisms are disclosed for a dishwasher door. Such device can be used not only within a dishwasher but also within other devices. The various options discussed above with the three different examples can readily be combined in various ways to achieve further examples embodying aspects of the present invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A consumer appliance with a soft open door mechanism comprising:

a cabinet having a top and a bottom and defining an opening along a front side;

a door having a top and a bottom and attached by a hinge to the front side of the cabinet, the hinge at a bottom of the door so that the door is movable between an upright position closing the opening and a substantially horizontal position opening the opening;

a line having a first end connected to the cabinet at a connection point spaced toward the top of the cabinet from the hinge and having a second end attached to a door arm extending from the door adjacent the hinge, the line including a tension spring that is stretched in tension during opening of the door;

a roller attached to the cabinet spaced inwardly from the door, a central portion of the line passing through the roller; and a damping device mounted within the cabinet activatable by an opening movement of the door toward the horizontal position to slow the door motion, the damping device including a piston movable within a hydraulic chamber filled with gas and a hydraulic fluid, the chamber holding a substantially higher amount of gas than hydraulic fluid for providing a damping force only near the end of travel of the piston as the door nears the horizontal position, the ratio of gas to hydraulic fluid being approximately 9:1 so that damping activation occurs only after the piston has moved approximately 90% of its travel within the hydraulic chamber and the door has moved approximately 90% of its travel from the upright position to the substantially horizontal position.

2. The consumer appliance of claim 1, wherein the damping device is mounted so as to operate in compression.

3. The consumer appliance of claim 1, wherein the damping device is mounted so as to operate in extension.

4. The consumer appliance of claim 1, wherein the damping device is configured to slow motion toward the horizontal position in an increasing amount as the door is opened.

5. The consumer appliance of claim 1, wherein the damping device is mounted between the door arm and the cabinet.

6. The consumer appliance of claim 1, wherein the damping device is mounted between two spaced apart mounting areas within the cabinet, the line including a stop that contacts the damping device to activate the damping device when the door is moved toward the horizontal position.

7. The consumer appliance of claim 6, wherein the stop does not contact the damping device until the door has moved away from the vertical position.

8. The consumer appliance of claim 1, wherein the damping device is mounted at one end to the cabinet and at the other end to a damper arm pivotally mounted to the cabinet, the damper arm being pivotable by the door arm when the door is moved to the horizontal position to activate the damper.

9. The consumer appliance of claim 8, wherein the door arm does not contact the damper arm until the door has moved away from the vertical position.

10. The consumer appliance of claim 1, wherein the damping device is one of a hydraulic or pneumatic piston damper.

11. A consumer appliance with a soft open door mechanism comprising:

a cabinet having a top and a bottom and defining an opening along a front side;

a door having a top and a bottom and attached by a hinge to the front side of the cabinet, the hinge at a bottom of the door so that the door is movable between an upright position closing the opening and a substantially horizontal position opening the opening;

a spring mounted in the cabinet so as to oppose movement of the door toward the horizontal position; and a damping device mounted within the cabinet activatable by an opening movement of the door toward the horizontal position to slow the door motion, the damping device including a piston movable within a hydraulic chamber filled with gas and a hydraulic fluid, the chamber holding a substantially higher amount of gas than hydraulic fluid for providing a damping force only near the end of travel of the piston as the door nears the horizontal position, the ratio of gas to hydraulic fluid being approximately 9:1 so that damping activation occurs only after the piston has moved approximately 90% of its travel within the hydraulic chamber and the door has moved approximately 90% of its travel from the upright position to the substantially horizontal position.

12. The consumer appliance of claim 11, wherein the damping device is a partial fill damping device physically actuated by movement of the door starting with movement from the closed position.

13. The consumer appliance of claim 11, wherein the damping device in not physically actuated by movement the door until the door has moved a distance from the upright position toward the horizontal position.

14. The consumer appliance of claim 11, wherein the damping device is one of a hydraulic or pneumatic piston damper.

* * * * *

UNITED STATES PATENT AND TRADEMARK OFFICE

CERTIFICATE OF CORRECTION

PATENT NO. : 8,292,381 B2
APPLICATION NO. : 12/986445
DATED : October 23, 2012
INVENTOR(S) : Aaron Matthew McDaniel and John Alexander Gardner It is certified that error appears in the above-identified patent and that said Letters Patent is hereby corrected as shown below:

Column 8 Line 60 "...damping device in not physically actuated..." should read --...damping device is not physically actuated...--

Signed and Sealed this
Twelfth Day of March, 2013

Teresa Stanek Rea
*Acting Director of the United States Patent and Trademark Office*